US008160482B2

(12) United States Patent
Nakura

(10) Patent No.: US 8,160,482 B2
(45) Date of Patent: Apr. 17, 2012

(54) BELT DEVICE AND IMAGE FORMING APPARATUS

(75) Inventor: Makoto Nakura, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 849 days.

(21) Appl. No.: 12/198,530

(22) Filed: Aug. 26, 2008

(65) Prior Publication Data

US 2009/0062048 A1 Mar. 5, 2009

(30) Foreign Application Priority Data

Aug. 29, 2007 (JP) ..... 2007-222519

(51) Int. Cl.
*G03G 15/01* (2006.01)
*G03G 15/00* (2006.01)
*G03G 15/20* (2006.01)

(52) U.S. Cl. ..... 399/302; 399/165; 399/308; 399/313

(58) Field of Classification Search ..... 399/165, 399/302, 303, 308, 312, 313, 395; 474/135, 474/112

See application file for complete search history.

(56) References Cited

U.S. PATENT DOCUMENTS 5,717,984 A * 2/1998 Wong ..... 399/165
6,104,899 A * 8/2000 Hokari et al. ..... 399/165
6,321,052 B1 * 11/2001 Yamashina et al. ..... 399/165
6,496,672 B2 * 12/2002 Asuwa et al. ..... 399/165
2007/0144871 A1 * 6/2007 Tao et al. ..... 198/810.03

FOREIGN PATENT DOCUMENTS

| | | |
|---|---|---|
| JP | 3082452 | 6/2000 |
| JP | 3135077 | 12/2000 |
| JP | 2001-83840 | 3/2001 |
| JP | 2003-237975 | 8/2003 |
| JP | 2006-343629 | 12/2006 |

OTHER PUBLICATIONS

U.S. Appl. No. 12/104,127, filed Apr. 16, 2008, Satoru Tao, et al.
U.S. Appl. No. 12/076,813, filed Mar. 24, 2008.
Office Action mailed Feb. 17, 2012, in Japanese Patent Application No. 2007-222519, filed Aug. 29, 2007.

* cited by examiner

*Primary Examiner* — Sandra Brase
(74) *Attorney, Agent, or Firm* — Oblon, Spivak, McClelland, Maier & Neustadt, L.L.P.

(57) ABSTRACT

A belt member is supported by a plurality of roller members including a first roller member and moves in a predetermined direction of movement. A coupling member is coupled with the first roller member. An abutting member makes contact with the coupling member by changing tilting of a rotational axis of the first roller member and moves the coupling member in a forward direction and a reverse direction to correct meandering of the belt member. Abutting positions of the coupling member with respect to the abutting member when moving the coupling member in the forward direction and in the reverse direction are variable to support respective movement directions.

2 Claims, 5 Drawing Sheets

BELT DEVICE AND IMAGE FORMING APPARATUS

CROSS-REFERENCE TO RELATED APPLICATIONS

The present application claims priority to and incorporates by reference the entire contents of Japanese priority document 2007-222519 filed in Japan on Aug. 29, 2007.

BACKGROUND OF THE INVENTION

1. Field of the Invention

The present invention relates to an image forming apparatus employing an electrophotographic method such as a copier, a printer, a facsimile, or a multifunction product and a belt device installed therein, and more particularly, to a belt device and image forming apparatus that corrects meandering of a belt member such as an intermediate transfer belt, a transfer belt, or a photosensitive belt.

2. Description of the Related Art

A tandem-type color image forming apparatus including an intermediate transfer belt (belt device) is a typical type of an image forming apparatus such as a copier and a printer (see, for example, Japanese Patent Application Laid-open No. 2006-343629 and Japanese Patent Application Laid-open No. 2001-83840). Four photosensitive drums (image carriers) are provided side by side facing an intermediate transfer belt (belt member). The four photosensitive drums then form toner images for black, yellow, magenta, and cyan, respectively. The toner images for each of the colors formed on each photosensitive drum are then transferred and superimposed on the intermediate transfer belt. The toner images formed on the intermediate transfer belt are then transferred onto a recording medium as a full color image.

Technology such as disclosed, for example, in Japanese Patent Application Laid-open No. 2006-343629 and Japanese Patent No. 3082452, is also well-known. Here, at an image forming apparatus, displacement of an intermediate transfer belt in a width direction is detected and meandering (variation in a width-wise direction) of the intermediate transfer belt is corrected based on results of the detection. Specifically, in Japanese Patent Application Laid-open No. 2006-343629, an extent of displacement of a contact that abuts with an end in a width direction of the intermediate transfer belt (endless belt) and reciprocates in accordance with displacement of the intermediate transfer belt is detected by a displacement sensor. Displacement (meandering) of the intermediate transfer belt is then corrected by a meandering correction roller based on the detection results of the displacement sensor. Tilting of a rotational axis of a meandering correction roller is then changed so as to correct meandering of the intermediate transfer belt by causing a coupling member (reciprocating arm) coupled to the meandering correction roller where the intermediate transfer belt is suspended in a tensioned state to be reciprocated by an operation of an eccentric cam.

On the other hand, technology is disclosed in Japanese Patent No. 3082452 where a belt device includes a transfer belt (transfer material conveyor belt). Tilting of a rotational axis of a tensioning roller is then varied in order to correct meandering of the transfer belt by reciprocating a coupling member (support arm) coupled to the tensioning roller that tensions the transfer belt using a cam action.

There are also cases with image forming apparatus such as the image forming apparatus of Japanese Patent Application Laid-open No. 2006-343629 where the reciprocating arm coupled to the meandering correction roller is pinched by the coupling member and therefore does not follow the action of the eccentric cam. In this event, the reciprocating arm can stop in a raised state even if urged by a spring. Tilting of the rotational axis of the meandering correction roller cannot then be changed and it is no longer possible to correct meandering of the intermediate transfer belt.

Such problems are not limited to belt devices using an intermediate transfer belt as a belt member, but are common to belt devices that correct meandering of belt members such as a belt device using a transfer belt as a belt member or a belt device using a photosensitive belt as a belt member. It is therefore possible to provide a belt device and image forming apparatus capable of accurately correcting meandering of a belt member without inappropriate reciprocation of a coupling member using a comparatively straightforward structure even when a coupling member coupled to a roller member that corrects meandering of a belt member is pinched.

SUMMARY OF THE INVENTION

It is an object of the present invention to at least partially solve the problems in the conventional technology.

According to an aspect of the present invention, there is provided a belt device including a belt member that is supported by a plurality of roller members including a first roller member and moves in a predetermined direction of movement; a coupling member that is coupled with the first roller member; and an abutting member that makes contact with the coupling member by changing tilting of a rotational axis of the first roller member and moves the coupling member in a forward direction and a reverse direction to correct meandering of the belt member. An abutting position of the coupling member with respect to the abutting member when moving the coupling member in the forward direction and an abutting position of the coupling member with respect to the abutting member when moving the coupling member in the reverse direction are variable to support respective movement directions.

Furthermore, according to another aspect of the present invention, there is provided an image forming apparatus including a belt device that includes a belt member that is supported by a plurality of roller members including a first roller member and moves in a predetermined direction of movement; a coupling member that is coupled with the first roller member; and an abutting member that makes contact with the coupling member by changing tilting of a rotational axis of the first roller member and moves the coupling member in a forward direction and a reverse direction to correct meandering of the belt member. An abutting position of the coupling member with respect to the abutting member when moving the coupling member in the forward direction and an abutting position of the coupling member with respect to the abutting member when moving the coupling member in the reverse direction are variable to support respective movement directions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
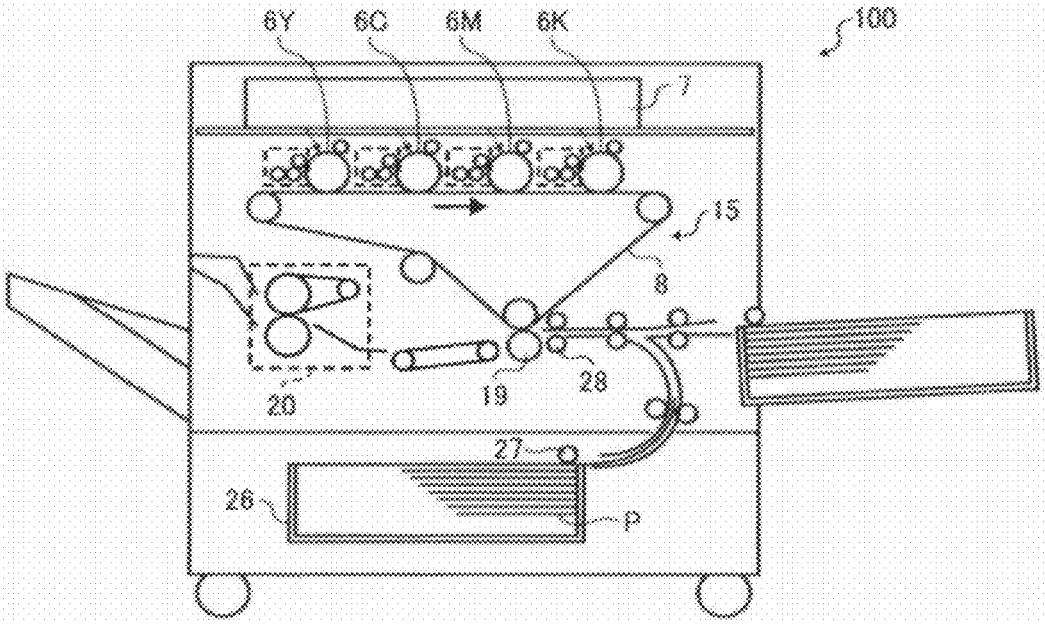
FIG. 1 is an overall diagram of an image forming apparatus according to an embodiment of the present invention.

Exemplary embodiments of the present invention are explained in detail below with reference to the accompanying drawings. Corresponding or identical portions in the drawings are given the same numerals, with duplicate explanations being simplified or omitted as appropriate.

Figure 2:
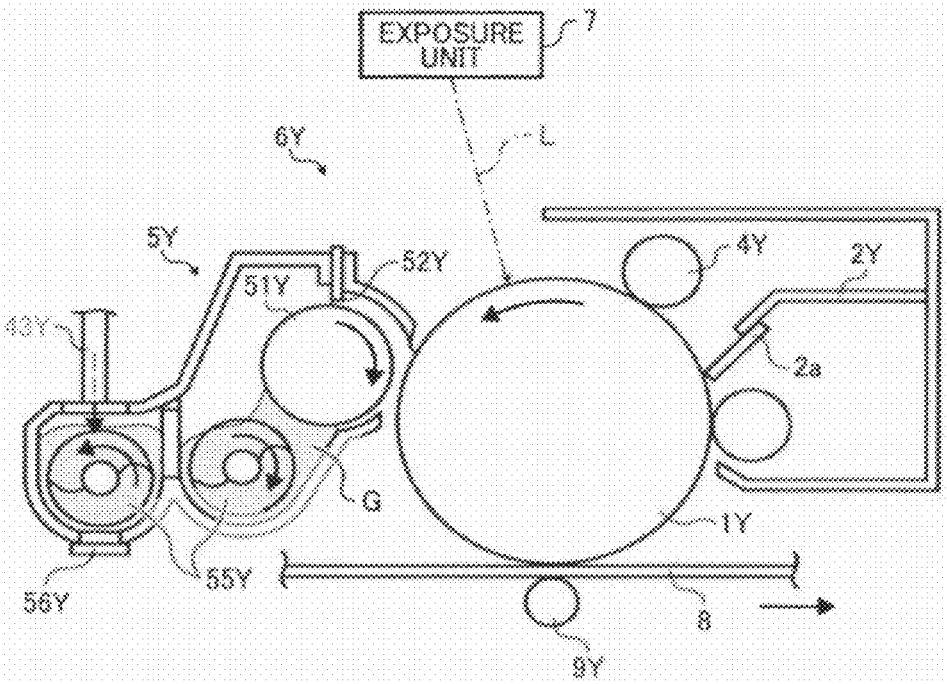
FIG. 2 is a cross-sectional view of an image-forming unit of the image forming apparatus of FIG. 1.

First, an overall structure and operation of an image forming apparatus is explained with reference to FIGS. 1 and 2. FIG. 1 is a schematic diagram showing a printer as an image forming apparatus, and FIG. 2 is an enlarged view of working parts of the printer. As shown in FIG. 1, an intermediate transfer belt device 15 is disposed at a belt device at the center of a main body 100 of the image forming apparatus. Operation units 6Y, 6M, 6C, 6K corresponding to each color (yellow, magenta, cyan, black) are then disposed next to each other facing an intermediate transfer belt 8 (belt member) of the intermediate transfer belt device 15.

Referring to FIG. 2, the operation unit 6Y corresponding to yellow includes a photosensitive drum 1Y as an image carrier, an electrostatic charging unit 4Y disposed at the periphery of an electrostatic drum 1Y, a developing unit 5Y, a cleaning unit 2Y, and a charge removal unit (not shown). A developing process (charging, exposure, developing, transfer, cleaning) is carried out on the photosensitive drum 1Y. A yellow image is therefore formed on the photosensitive drum 1Y.

With the exception of the color of the toner used being different, the remaining three operation units 6M, 6C, 6K have substantially the same structure as the operation unit 6Y for yellow and form images corresponding to the respective toner colors. In the following, a description is given only of the operation unit 6Y, with descriptions of the remaining three operation units 6M, 6C, 6K being omitted as appropriate.

Referring to FIG. 2, the photosensitive drum 1Y is rotated in an anti-clockwise direction by a drive motor (not shown). The surface of the photosensitive drum 1Y is similarly charged at the position of the electrostatic charging unit 4Y (charging). After this, the surface of the photosensitive drum 1Y reaches an irradiation position of laser light L emitted from an exposure unit 7. A latent image corresponding to yellow is then formed by exposure scanning at this position (exposure).

The surface of the photosensitive drum 1Y then reaches a position corresponding to the developing unit 5Y. A latent image is developed at this position and a yellow toner image is formed (development). The surface of the photosensitive drum 1Y then reaches a position corresponding to the intermediate transfer belt 8 (belt member) and the transfer roller 9Y. A toner image on the photosensitive drum 1Y is then transferred onto the intermediate transfer belt 8 at this position (primary transfer). A small amount of un-transferred toner remains on the photosensitive drum 1Y at this time.

The surface of the photosensitive drum 1Y then reaches a position corresponding to the cleaning unit 2Y. Un-transferred toner remaining on the photosensitive drum 1Y at this position is then recovered to within the cleaning unit 2Y by a cleaning blade 2*a* (cleaning). Finally, the surface of the photosensitive drum 1Y reaches a position corresponding to the charge removal unit (not shown). Residual potential on the photosensitive drum 1Y is then removed at this position. A series of development processes carried out on the photosensitive drum 1Y are then complete.

The development processes for the operation units 6M, 6C, 6K are the same as for the yellow operation unit 6Y. Laser light L based on image information is irradiated from the exposure unit 7 disposed above the operation unit towards photosensitive drums 1M, 1C, 1K of each operation unit 6M, 6C, 6K. The exposure unit 7 emits the laser light L from a light source and irradiates the photosensitive drum with the laser light L via a plurality of optical elements while scanning with the laser light using a rotated polygon mirror. Toner images for each color formed on each photosensitive drum via the developing step are then overlaid and transferred onto the intermediate transfer belt 8. A color image can then be formed on the intermediate transfer belt 8.

Figure 3:
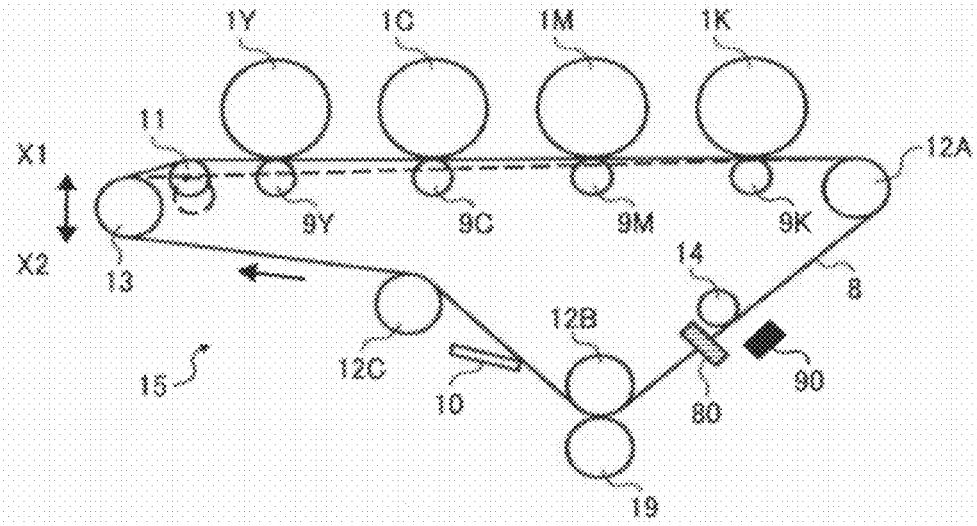
FIG. 3 is a diagram of a belt device installed at the image forming apparatus of FIG. 1.

Referring to FIG. 3, the intermediate transfer belt device 15 (belt device) includes the intermediate transfer belt 8, four transfer rollers 9Y, 9M, 9C, and 9K, a drive roller 12A, a secondary transfer opposing roller 12B, a tension roller 12C, a correction roller 13, a moveable roller 11, a restricting roller 14, a detecting unit 80, a photosensor 90, and an intermediate transfer cleaning unit 10. The intermediate transfer belt 8 spans across in a tensioned manner, is supported by a plurality of roller members 11, 12A to 12C, and 13 and is endlessly driven by drive force of one roller member (drive roller) 12A in the direction of an arrow in FIG. 3.

The four transfer rollers 9Y, 9M, 9C, and 9K form a primary transfer nip by sandwiching the intermediate transfer belt 8 together with the photosensitive drums 1Y, 1M, 1C, and 1K. A transfer voltage (transfer bias) of a polarity opposite to the toner polarity is then applied to the transfer rollers 9Y, 9M, 9C, and 9K. The intermediate transfer belt 8 then moves in the direction of the arrow and sequentially passes through the primary transfer nip of the transfer rollers 9Y, 9M, 9C, and 9K. Toner images for each of the colors on the photosensitive drums 1Y, 1M, 1C, and 1K then undergo primary transfer so as to be overlaid on the intermediate transfer belt 8.

After this, the intermediate transfer belt 8 to which the toner images for each of the colors have been transferred reaches a position facing a secondary transfer roller 19. At this position, the secondary transfer opposing roller 12B sandwiches the intermediate transfer belt 8 together with the secondary transfer roller 19 so as to form a secondary transfer nip. Toner images for the four colors formed on the intermediate transfer belt 8 are then transferred onto a recording medium P such as transfer paper conveyed to the position of the secondary transfer nip. At this time, un-transferred toner that was not transferred to the recording medium P remains at the intermediate transfer belt 8.

After this, the intermediate transfer belt 8 reaches the position of the intermediate transfer cleaning unit 10. Un-transferred toner on the intermediate transfer belt 8 is then removed at this position. The series of transfer processes taking place on the intermediate transfer belt 8 are then complete. The structure and operation of the intermediate transfer belt device 15 taken as a belt device are now explained in detail using FIGS. 3 to 8.

Referring to FIG. 1, the recording medium P conveyed to the position of the secondary transfer nip is conveyed from a paper feeding unit 26 disposed at the bottom of the main body 100 (or a paper feeding unit disposed at a side) via a paper feeding roller 27 and a resist roller pair 28, etc. Specifically, a plurality of recording media P such as transfer paper is housed one on top of another at the paper feeding unit 26. When the paper feeding roller 27 is rotated in an anti-clockwise direction of FIG. 1, an uppermost recording medium P is fed in a direction to between the rollers of the resist roller pair 28.

The recording medium P conveyed to the resist roller pair 28 is then temporarily stopped at the position of a roller nip of the resist roller pair 28 for which rotation has stopped. The resist roller pair 28 is then rotated in line with the timing of a color image on the intermediate transfer belt 8 and the recording medium P is conveyed in the direction of the secondary transfer nip. An image of the desired color is therefore transferred onto the recording medium P.

After this, the recording medium P to which the color image is transferred to at the position of the secondary transfer nip is conveyed to the position of a fixing unit 20. At this position, the color image transferred to the surface is fixed onto the recording medium P using heat and pressure of a fixing roller and a pressure roller. The recording medium P is then discharged to outside of the device by a pair of paper ejection rollers (not shown). The recording media P subjected to transfer discharged to outside of the device by the pair of paper ejection rollers is then sequentially stacked on a stack unit as outputted images. The series of image-forming processes occurring at the image forming apparatus are then complete.

Next, a detailed description is given of the structure and operation of the developing unit of the operation unit in FIG. 2. The developing unit 5Y includes a developing roller 51Y facing the photosensitive drum 1Y, a doctor blade 52Y facing the developing roller 51Y, two conveyor screws 55Y disposed within a developer container, a toner supply path 43Y communicating via an opening at the developer container, and a density detection sensor 56 that detects toner density within the developer. The developing roller 51Y includes a magnet installed inside and a sleeve rotating the periphery of the magnet. A two-component developer composed of a carrier and a toner is housed within the developer container.

The developing unit 5Y operates as follows. The sleeve of the developing roller 51Y rotates in the direction of the arrow of FIG. 2. Developer supported on the developing roller 51Y by a magnetic field formed by a magnet moves on the developing roller 51Y in accompaniment with rotation of the sleeve. Developer within the developing unit 5Y is adjusted so that a proportion (toner density) of toner within the developer is within a predetermined range. The toner supplied to within the developer container is then circulated in two isolated developer containers while being mixed and agitated together with the developer by the two conveyor screws 55Y (movement in a direction perpendicular to the paper in FIG. 2). The toner in the developer is then absorbed by the carrier as a result of frictional electrification with the carrier and is supported on the developing roller 51Y together with the carrier due to magnetic force present at the developing roller 51Y.

The developer supported on the developing roller 51Y is conveyed in the direction of the arrow of FIG. 2 and reaches the position of the doctor blade 52Y. The developer on the developing roller 51Y is then conveyed as far as a position (developing region) facing the photosensitive drum 1Y after the amount of developer is optimized at this position. The toner is then absorbed at the latent image formed on the photosensitive drum 1Y by the electric field formed at the developing region. The developer remaining on the developing roller 51Y then reaches the upper part of the developer container in accompaniment with rotation of the sleeve and the developing roller 51Y is then separated at this position.

Figure 4A:
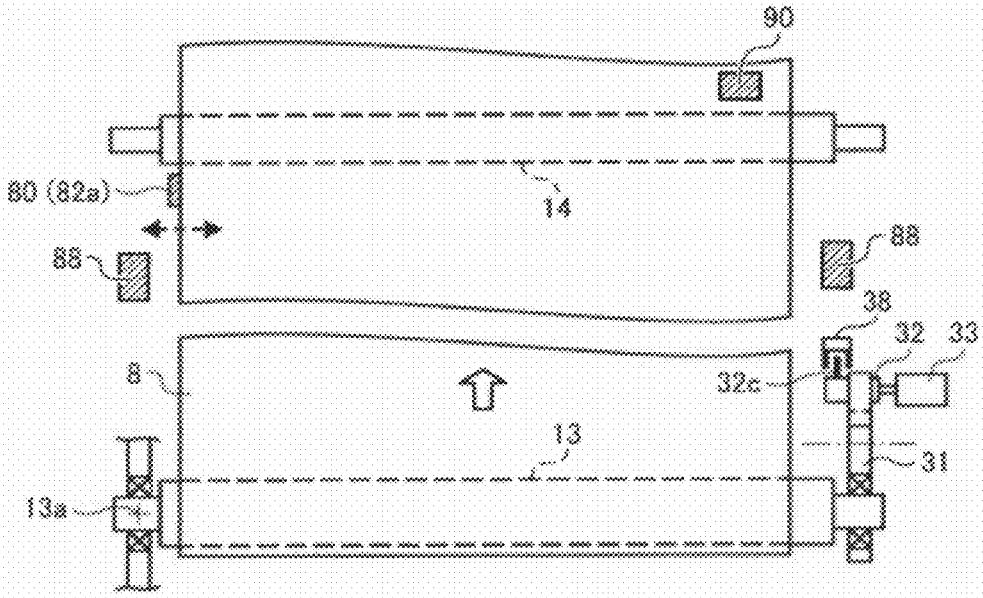
FIG. 4A is an outline view of a part of the belt device as viewed in a widthwise direction.
Figure 4B:
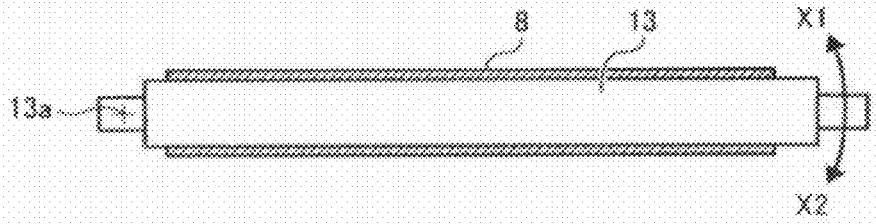
FIG. 4B is an outline view of part of the belt device illustrating reciprocation.
Figure 5:
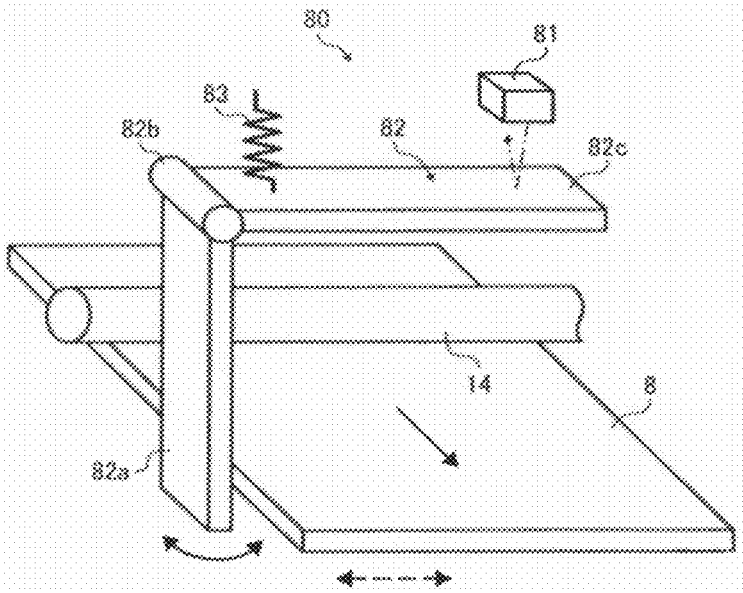
FIG. 5 is a perspective view of the vicinity of a detecting unit.
Figure 6:
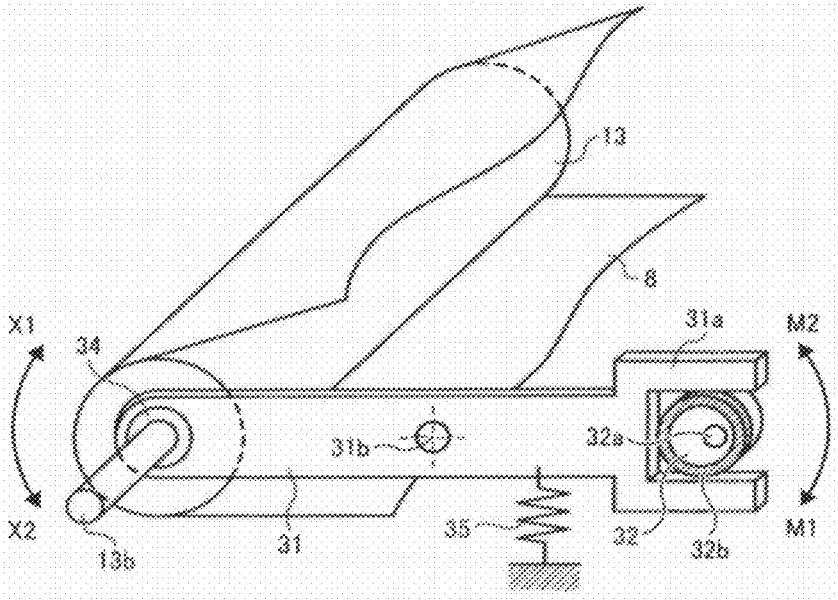
FIG. 6 is a perspective view of the vicinity of a correction roller.

Next, in FIGS. 3 to 8, the intermediate transfer belt device 15 (belt device) of the embodiment is explained. FIG. 3 is a schematic diagram showing the intermediate transfer belt device 15 taken as a belt device. FIG. 4A is an outline plan view of part of the intermediate transfer belt device 15 viewed in a widthwise direction. FIG. 4B is an outline side view of part of the intermediate transfer belt device 15 viewed in a widthwise direction. FIG. 5 is a perspective view showing the vicinity of the detecting unit 80 at the intermediate transfer belt device 15. FIG. 6 is a perspective view showing the vicinity (meandering correction mechanism) of the correction roller 13 at the intermediate transfer belt device 15. FIGS. 7 and 8 are schematic views showing the operation of a reciprocating arm 31 that is a coupling member.

Referring to FIGS. 3 and 4, the intermediate transfer belt device 15 (belt device) includes the intermediate transfer belt 8 that is the belt member, the four transfer rollers 9Y, 9M, 9C, and 9K, the drive roller 12A, the secondary transfer opposing roller 12B, the tension roller 12C, the correction roller 13, the moveable roller 11, the restricting roller 14, the detecting unit 80, the photosensor 90, the intermediate transfer cleaning unit 10, and an abnormality detection sensor 88.

The intermediate transfer belt 8 taken as a belt member is disposed facing the photosensitive drums 1Y, 1M, 1C, and 1K taken as four image carriers supporting toner images for each color. The intermediate transfer belt 8 is supported in a tensioned manner mainly the five roller members (drive roller 12A, secondary transfer opposing roller 12B, tension roller 12C, moveable roller 11, and correction roller 13).

In the embodiment, the intermediate transfer belt 8 can be formed from one or a plurality of layers of PVDF (polyvinylidene fluoride), ETFE (ethylene tetrafluoroethylene), PI (polyamide), or PC (polycarbonate) etc. dispersed in a conductive material such as carbon black. The intermediate transfer belt 8 is adjusted to have a volume resistivity of $10^7$ to $10^{12}$ ohms/cm, and the surface resistivity of the rear surface side of the belt is adjusted to the range of $10^8$ to $10^{12}$ ohms/cm. The intermediate transfer belt 8 is set with a thickness in the range of 80 to 100 micrometers. In the embodiment, the thickness of the intermediate transfer belt 8 is set to 90 micrometers. It is then possible to coat the surface of the intermediate transfer belt 8 with a separating layer as necessary. During this time, a fluororesin such as ETFE (ethylene tetrafluoroethylene), PTFE (polytetrafluoroethylene), PVDF (polyvinylidene fluoride), PEA (perfluoroalkoxy), FEP (fluorinated ethyl propylene copolymer), or PVF (polyvinyl fluoride) is used but this is not limiting. The method for manufacturing the intermediate transfer belt 8 can be an injection method or a centrifugal forming method etc. with the surface being polished as necessary.

The transfer rollers 9Y, 9M, 9C, and 9K face the corresponding photosensitive drums 1Y, 1M, 1C, and 1K via the intermediate transfer belt 8. Specifically, the yellow transfer roller 9Y faces the yellow photosensitive drum 1Y via the intermediate transfer belt 8, the magenta transfer roller 9M faces the magenta photosensitive drum 1M via the intermediate transfer belt 8, the cyan transfer roller 9C faces the cyan photosensitive drum 1C via the intermediate transfer belt 8, and the black transfer roller 9K faces the photosensitive drum 1C via the intermediate transfer belt 8.

The moveable roller 11 is supported at a support member (not shown) together with the four transfer rollers 9Y, 9M, 9C, and 9K and the intermediate transfer belt 8 is distanced from the photosensitive drums 1Y, 1M, 1C, and 1K. Specifically, the intermediate transfer belt 8 moves away from the photosensitive drums 1Y, 1M, 1C and 1K (moves to a position denoted by a dashed line) as a result of the moveable roller 11 moving to the bottom of FIG. 3 together with the four transfer rollers 9Y, 9M, 9C, and 9K. The operation of distancing the intermediate transfer belt 8 from the photosensitive drums 1Y, 1M, 1C, and 1K is performed in order to reduce wear on the intermediate transfer belt 8 and is therefore performed when image-forming is not taking place. Further, although not shown in the drawings, when a monochrome image is formed, the intermediate transfer belt 8 abuts with only the black photosensitive drum 1K as a result of the moveable roller 11 moving downwards together with the three transfer rollers 9Y, 9M, 9C.

The drive roller 12A is rotated by a drive motor (not shown). This causes the intermediate transfer belt 8 to advance a predetermined extent in the direction of movement (clockwise direction of FIG. 3). The secondary transfer opposing roller 12B abuts with the secondary transfer roller 19 via the intermediate transfer belt 8. The other tension roller 12C abuts with the outer peripheral surface of the intermediate transfer belt 8. The intermediate transfer cleaning unit 10 (cleaning blade) is disposed between the secondary transfer opposing roller 12B and the tension roller 12C.

The detecting unit 80 (detecting unit) detects displacement of the intermediate transfer belt 8 in a widthwise direction (direction perpendicular to the paper of FIG. 3) at the intermediate transfer belt device 15 of the embodiment. Referring to FIG. 5, the detecting unit 80 includes a reciprocating member 82 abutting with a widthwise direction end of the intermediate transfer belt 8, a distance sensor 81 (main sensor unit) that detects the extent of displacement of the reciprocating member 82, and a spring 83 that urges the reciprocating member 82 in a direction of abutment with the intermediate transfer belt 8.

The reciprocating member 82 includes a first arm section 82*a*, a rotating support shaft 82*b*, and a second arm section 82*c*. An end of the first arm section 82*a* abuts with a width direction end of the intermediate transfer belt 8 and the other end is fixed to the rotating support shaft 82*b*. The rotating support shaft 82*b* is supported in a freely rotating manner at a casing (not shown) of the intermediate transfer belt device 15. An end of the second arm section 82*c* is fixed to the rotating support shaft 82*b*. An end of the spring 83 is connected to the center of the second arm section 82*c*. The other end of the spring 83 is connected to the casing. The reciprocating member 82 reciprocates (reciprocation in the direction of the solid arrows in FIG. 5) in accordance with displacement (the belt tends to go in the direction of the dashed line arrows in FIG. 5) of the intermediate transfer belt 8 in the widthwise direction. In the embodiment, the intermediate transfer belt 8 is set to travel at 400 mm/second in the direction of movement (direction of an arrow in FIG. 5).

The distance sensor 81 is installed at the upper part of the other end of the second arm section 82*c* of the reciprocating member 82 (fixed to the casing). The distance sensor 81 (main sensor unit) mainly includes light-emitting elements (infra-red light-emitting diodes) disposed next to each other spaced across the horizontal direction and a position sensing detector (PSD). Infra-red light emitted from the light-emitting elements is reflected by the surface of the second arm section 82*c* so as to be incident to the position detecting elements as reflected light. At this time, a position of incidence of the reflected light incident to the position detecting elements is changed using the distance between the distance sensor 81 and the second arm section 82*c*. An output value of a light-receiving element (the distance sensor 81) then changes in proportion to this. It is therefore possible to detect an extent of displacement (distance to the surface of the second arm section 82*c*) of the intermediate transfer belt 8 in a width-wise direction. When a distance detected by the distance sensor 81 is smaller than a predetermined value, the intermediate transfer belt 8 is displaced to the right side of FIG. 5 with regards to a target position. When the distance detected by the distance sensor 81 is larger than a prescribed value, the intermediate transfer belt 8 is displaced to the left side of FIG. 5 with respect to the target position.

Here, the restricting roller 14 that restricts the displacement of the intermediate transfer belt 8 in a direction different to the widthwise direction and the direction of movement is disposed near to the detecting unit 80. Specifically, the restricting roller 14 is near (on an upstream side in the direction of movement of the intermediate transfer belt 8 with respect to the abutting position) an abutting position of the reciprocating member 82 (first arm section 82*a*) and the intermediate transfer belt 8. With the above structure, displacement (runout) in a direction (direction at right-angles to the paper in FIG. 4) perpendicular to the widthwise direction of the intermediate transfer belt 8 at the detecting unit 80 (position of abutment of the reciprocating member 82 and the intermediate transfer belt 8) is alleviated. Namely, the intermediate transfer belt 8 restricts displacement of the position of the detecting unit 80 in an orthogonal direction in order to increase belt tensioning by the restricting roller 14. In addition to detecting a detection component originally intended for detection (detection component in a widthwise direction), the inconvenience of also detecting a displacement component for different directions to the widthwise direction and the direction of movement is also reduced by the detecting unit 80. Namely, the detection precision with respect to shifting of the intermediate transfer belt 8 is improved by the detecting unit 80.

When displacement (extent of displacement) of the intermediate transfer belt 8 is detected by the detecting unit 80, displacement in a widthwise direction of the intermediate transfer belt 8 is corrected by the correction roller 13 (meandering correction mechanism) based on the detection results. Referring to FIG. 3, the correction roller 13 is disposed upstream in a direction of movement of the intermediate transfer belt 8 with respect to the photosensitive drums 1Y, 1M, 1C, and 1K and makes contact with the inner surface of the intermediate transfer belt 8. Referring to FIG. 4 and FIG. 6, the correction roller 13 reciprocates in directions X1 and X2 (up and down) taking a center of reciprocation 13*a* (supported at a side plate via the bearings) as center as a result of the reciprocating arm 31 reciprocating due to rotation of a cam 32. When the intermediate transfer belt 8 is displaced to the right side (as viewed from the belt) in FIG. 4A, the correction roller 13 reciprocates in the X1 direction based on the detection results so as to correct displacement (meandering correction) of the intermediate transfer belt 8. When the intermediate transfer belt 8 is then displaced to the left side in FIG. 4A, the correction roller 13 reciprocates in the direction X2 based on the detection results so as to carry out displacement correction (meandering correction) of the intermediate transfer belt 8. This makes it possible to prevent the intermediate transfer belt 8 from meandering or the intermediate transfer belt 8 from becoming damaged as a result of being displaced substantially in a widthwise direction (towards the belt) so as to come into contact with other members. The structure and operation of the meandering correction mechanism is explained in the following using FIG. 6 to FIG. 8.

In the embodiment, the detecting unit 80 and the restricting roller 14 are disposed at positions away from the correction roller 13. Specifically, the correction roller 13 is disposed upstream of the direction of movement of the intermediate transfer belt 8 with respect to the opposing regions of the intermediate transfer belt 8 and the photosensitive drums 1Y, 1M, 1C, and 1K. On the other hand, the detecting unit 80 and the restricting roller 14 are disposed downstream of the direction of movement of the intermediate transfer belt 8 with respect to the opposing regions of the intermediate transfer belt 8 and the photosensitive drums 1Y, 1M, 1C, and 1K. The detection precision of the detecting unit 80 can therefore be improved without reducing restrictive force (constraining force with regards to displacement in an orthogonal direction) of the restricting roller 14 with respect to the intermediate transfer belt 8 even if reciprocation (correction) is carried out by the correction roller 13 by positioning the detecting unit 80 and the restricting roller 14 away from the correction roller 13.

Referring to FIG. 4, with the intermediate transfer belt device 15 of the embodiment, the abnormality detection sensor 88 is positioned a prescribed distance (in the order of 5 mm) away from both ends in a widthwise direction of the intermediate transfer belt 8. Although not shown in the drawings, the abnormality detection sensor 88 includes an arm member making contact with the intermediate transfer belt 8 that is substantially to the belt side, and an optical sensor that optically detects movement taking an axis of rotation of the arm member due to contact with the intermediate transfer belt 8 as center. The abnormality detection sensor 88 detects when the intermediate transfer belt 8 has gone outside a range correctable by the correction roller 13. When the abnormality detection sensor 88 then makes an abnormal direction, driving of the intermediate transfer belt 8 (the drive roller 12A) is forcibly stopped and a display to the effect of "please call the service staff" (a display indicating to make a request for repair to the service staff) is displayed at the main body 100.

Referring to FIG. 3 and FIG. 4, at the intermediate transfer belt device 15 of the embodiment, the photosensor 90 is near the restricting roller 14. The photosensor 90 detects the position and density of the toner images (batch pattern) supported at the intermediate transfer belt 8 and optimizes the image-producing conditions. Specifically, shifts in positions of toner images (batch patterns) for each color formed on the intermediate transfer belt 8 via the image-forming processes are optically detected by the photosensor 90. The timing of the exposure of each of the photosensitive drums 1Y, 1M, 1C, and 1K by the exposure unit 7 is then adjusted based on the detection results. The density (toner density) of toner images (batch patterns) formed on the intermediate transfer belt 8 via the image-forming processes is optically detected by the photosensor 90. The toner density of the developer housed in the developing unit 5 is then adjusted based on the detection results. It is then possible to alleviate shaking of the surface of the intermediate transfer belt 8 detected by the photosensor 90 by installing the photosensor 90 in the vicinity of the restricting roller 14. The distance with the toner image detected by the photosensor 90 is therefore stable and the detection precision of the photosensor 90 with respect to the position and density of the toner images is improved.

The structure and operation of the meandering correction mechanism at the intermediate transfer belt device 15 of the embodiment is explained in detail below. Referring to FIG. 4 and FIG. 6, the meandering correction mechanism includes the correction roller 13 (one of a plurality of roller members the intermediate transfer belt 8 is laid across in a tensioned state), the reciprocating arm 31 taken as an coupling member, the cam 32 taken as an abutting member, a tensioning spring 35 taken as an urging member, a drive motor 33, and a position detection sensor 38.

The reciprocating arm 31 taken as the coupling member is a metal plate coupled to the correction roller 13. Referring to FIG. 6, an end of the reciprocating arm 31 is coupled to a shaft 13*b* of the correction roller 13 via a bearing 34. A reverse-c-shaped abutting section 31*a* is formed at the other side of the reciprocating arm 31 and sandwiches the cam 32 (abutting member) in forward and reverse directions M1 and M2. A central part (preferably the side of the abutting section 31*a*) of the reciprocating arm 31 is supported in a freely rotating manner at a side plate (not shown) of the device, is supported in a freely rotating manner, and constitutes a reciprocating center of oscillation 31*b* of the reciprocating arm 31.

In the embodiment, an end of the tensioning spring 35 taken as an urging member is connected between the abutting section 31*a* and the reciprocating center of oscillation 31*b*. The other end of the tensioning spring 35 is connected to the casing of the device. The reciprocating arm 31 (abutting section 31*a*) is therefore urged to reliably abut against the cam 32 as a result of installing the tensioning spring 35.

The cam 32 taken to be the abutting member abuts with the reciprocating arm 31 (abutting section 31*a*) and moves the reciprocating arm 31 in forward and reverse directions (directions X1, X2 of FIG. 6, or directions M1, M2) in order to change tilting of the rotational axis of the correction roller 13 with respect to the direction of movement and correct meandering of the intermediate transfer belt 8.

The cam 32 includes a circular outer peripheral surface that abuts with the reciprocating arm 31 (abutting section 31*a*). The reciprocating arm 31 is then made to move forwards and in reverse as a result of eccentric rotation of the cam 32. A shaft 32*a* of the cam 32 is located at an eccentric position and is connected to the drive motor 33. The cam 32 is then eccentrically rotated centered about the shaft 32*a* by rotational driving of the drive motor 33.

In the embodiment, the outer peripheral surface of the cam 32 is formed as a bearing 32*b*. At the cam 32, the bearing 32*b* (ball bearing) is press-fitted to an upper main part of a cam made of metal. Deterioration due to wear of the members 31, 32 can therefore be reduced because abrasive force due to abutting of the reciprocating arm 31 (abutting section 31*a*) and the cam 32 is reduced.

Figure 7A:
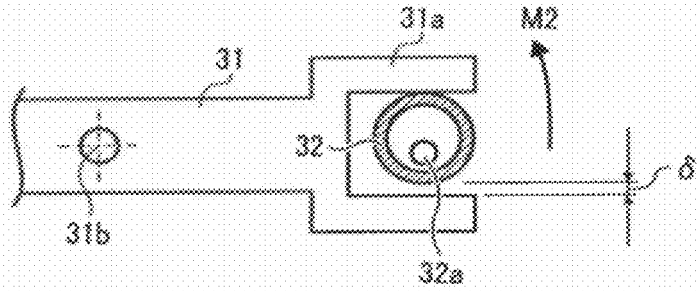
FIG. 7A is a schematic diagram of normal operation of a coupling member in a forward direction.
Figure 7B:
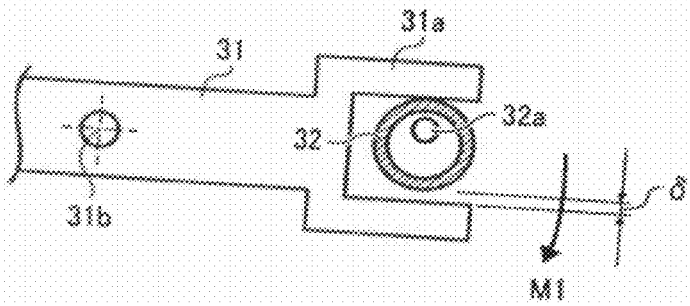
FIG. 7B is a schematic diagram of normal operation of a coupling member in a reverse direction.

The meandering correction mechanism normally operates as shown in FIG. 7. As shown in FIG. 7A, when the cam 32 rotates so that the position of the shaft 32*a* is lower than the center of the cam 32, the cam 32 abuts against the upper end of the abutting section 31*a* of the reciprocating arm 31 and the abutting section 31*a* is pushed up in the direction M2 (forward direction). The correction roller 13 therefore moves in the direction X2 of FIG. 6 taking the center of reciprocation 13*a* as center. As shown in FIG. 7B, when the cam 32 rotates so that the position of the shaft 32*a* is above the center of the cam 32, the abutting section 31*a* is pressed down in the direction M1 (reverse direction) with the cam 32 abutting with an upper end of the abutting section 31*a* of the reciprocating arm 31 due to the urging force of the tensioning spring 35. The correction roller 13 therefore moves in the direction X1 of FIG. 6 taking the center of reciprocation 13*a* as center.

Referring to FIG. 7A and FIG. 7B, a minute gap 5 is provided between the abutting section 31*a* and the cam 32. It is therefore possible to suppress malfunctioning where the cam 32 becomes pinched at the abutting section 31*a*. Referring to FIG. 4A, a detected plate 32*c* is installed at part of the outer peripheral surface of the cam 32. The position detection sensor 38 is installed at the intermediate transfer belt device 15. It is therefore possible to determine the posture of the direction of rotation of the cam 32 and to control the extent of movement of the correction roller 13 in the directions X1 and X2 by the position detection sensor 38 optically detecting the position of the detected plate 32*c*.

Figure 8A:
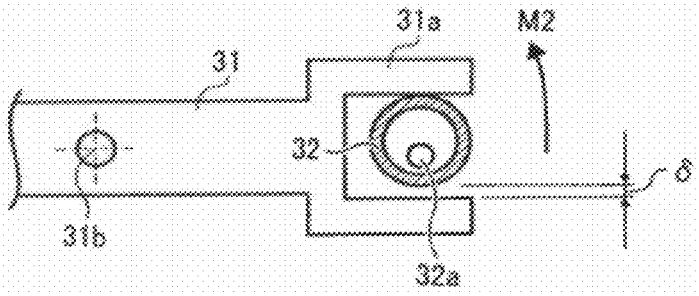
FIG. 8A is a schematic diagram of the operation of the coupling member in a forward direction when the coupling member is pinched.
Figure 8B:
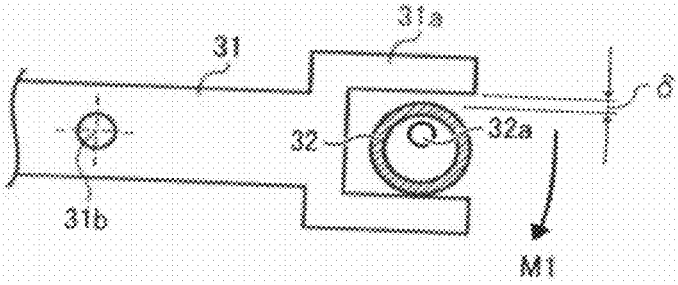
FIG. 8B is a schematic diagram of the operation of the coupling member in a reverse direction when the coupling member is pinched.

On the other hand, the meandering correction mechanism operates as shown in FIG. 8 when erroneous operation occurs with the reciprocating arm 31 in a pinched state. When the reciprocating arm 31 is pinched, at one end of the reciprocating arm 31, the bearing 34 is stressed with respect to the shaft 13*b* of the correction roller 13 so as to be locked. As shown in FIG. 8A, when the cam 32 rotates so that the position of the shaft 32*a* is lower than the center of the cam 32, the cam 32 abuts against the upper end of the abutting section 31*a* of the reciprocating arm 31 and the abutting section 31*a* is pushed up (this operation is the same as during normal operation) in the direction M2 (forward direction). The correction roller 13 therefore moves in the direction X2 of FIG. 6 taking the center of reciprocation 13*a* as center. Even if the reciprocating arm 31 is pinched, regardless of the urging force of the tensioning spring 35, when the cam 32 rotates and the position of the shaft 32*a* is above the center of the cam 32, as shown in FIG. 8B, the abutting section 31*a* is pushed down in the direction M1 (reverse direction) so that the cam 32 abuts with the lower end of the abutting section 31*a* of the reciprocating arm 31. The correction roller 13 therefore moves in the direction X1 of FIG. 6 taking the center of reciprocation 13*a* as center.

Figure 9A:
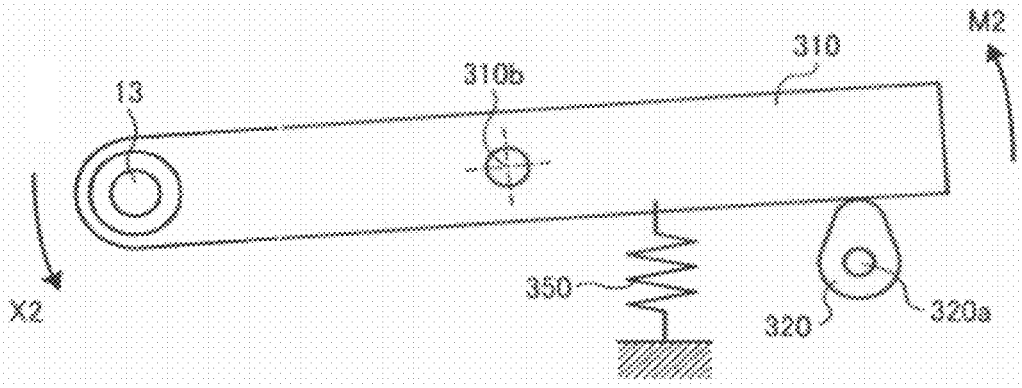
FIG. 9A Related Art
FIG. 9A is a schematic diagram of the operation of a conventional coupling member.
Figure 9B:
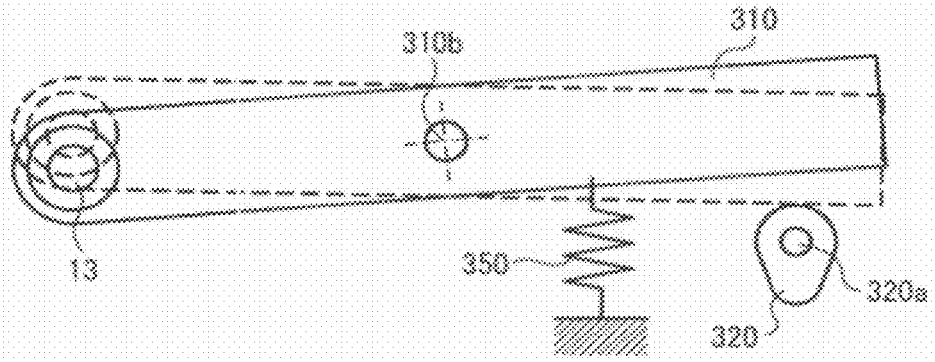
FIG. 9B Related Art
FIG. 9B is a schematic diagram of the operation of a conventional coupling member.

FIG. 9 is a schematic view showing the operation of a coupling member of a conventional meandering correction mechanism. As shown in FIG. 9A, when a cam 320 rotates so that the position of the axis 320*a* is low down, a reciprocating arm 310 rotates in the direction M2 (forward direction) centered about a reciprocating center of oscillation 310*b*. The correction roller 13 therefore moves in the direction X2 of FIG. 9 taking the other end as center. As shown in FIG. 9B, when the reciprocating arm 310 is pinched, there are cases where the reciprocating arm 310 is stopped while pushed upwards even if the cam 320 rotates and the position of the axis 320*a* is above regardless of the urging force of a tensioning spring 350. In this event, correction of meandering of the intermediate transfer belt cannot be achieved by the correction roller 13 because the reciprocating arm 310 does not follow the operation of the cam 320 (the position of the dashed line is followed).

In the embodiment, it is possible to change an abutment position (upper end of the abutting section 31*a*) of the reciprocating arm 31 with respect to the cam 32 when the reciprocating arm 31 moves in the forward direction M2 and an abutment position (lower end of the abutting section 31*a*) of the reciprocating arm 31 with respect to the cam 32 when the reciprocating arm 31 moves in the reverse direction M1 in a manner corresponding to the respective movement directions M1 and M2 so as to enable movement of the reciprocating arm 31. Here, the cam 32 abuts with the forward direction M2-side of the reciprocating arm 31 (abutting section 31*a*) when the reciprocating arm 31 moves in the forward direction M2. Further, the cam 32 abuts with the reverse direction M1-side of the reciprocating arm 31 (abutting section 31*a*) when the reciprocating arm 31 moves in the reverse direction M1. This means that even if the reciprocating arm 31 is pinched, this situation can be resolved immediately and it is possible to suppress erroneous operation at the reciprocating arm 31. An error occurs due to a minute gap 6 occurs due to a distance of movement of the correction roller 13 in the situation in FIG. 7B and the situation in FIG. 8B. However, the gap δ is minute and the influence on the belt meandering correction of this error is therefore negligible.

It is preferable for the outer peripheral surface of the cam 32 to be circular in order for the cam 32 to abut effectively at different positions (upper end and lower end) of the abutting section 31*a*. In the embodiment, the abutting section 31*a* of the reciprocating arm 31 is formed in a reverse-c-shape. However, the abutting section 31*a* can also be various shapes such as U-shaped or V-shaped providing that the cam 32 abuts at the side of the forward direction M2 of the abutting section 31*a* when the reciprocating arm 31 moves in the forward direction M2 and the cam 32 abuts with the side of the reverse direction M1 of the abutting section 31*a* when the reciprocating arm 31 moves in the reverse direction M1.

With the intermediate transfer belt device 15 of the embodiment, a position of abutment of the reciprocating arm 31 with respect to the cam 32 (abutting member) when the reciprocating arm 31 (coupling member) moves in a forward direction M2 and a position of abutment of the reciprocating arm 31 with respect to the cam 32 when the reciprocating arm 31 moves in the reverse direction M1 can be changed to correspond to the respective movement directions M1, M2 so as to enable movement of the reciprocating arm 31. This means that even if the reciprocating arm 31 coupled to the correction roller 13 that corrects meandering of the intermediate transfer belt 8 is pinched, it is possible to reliably correct meandering of the intermediate transfer belt 8 even if erroneous reciprocation of the reciprocating arm 31 occurs.

In the embodiment, the present invention is applied to a belt device (intermediate transfer belt device 15) employing the intermediate transfer belt 8 as a belt member. However, the present invention is also applicable to belt devices (a belt device that transfers toner images for a number of colors onto a recording medium while conveying the recording medium on a belt member) employing a transfer belt as a belt member. The present invention is also applicable to belt devices employing photosensitive belts (endless belt-shaped photosensitive members having the same function as the photosensitive drums of the embodiment) as photosensitive belts taken as belt members. In this case also, it is possible for the same results as for the embodiment to be obtained by giving a meandering correction mechanism that corrects meandering of the belt member the same structure as the embodiment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

a belt member that is supported by a plurality of roller members including a first roller member and moves in a predetermined direction of movement;

a coupling member that is coupled with the first roller member; and an abutting member that makes contact with the coupling member by changing tilting of a rotational axis of the first roller member and moves the coupling member in a forward direction and a reverse direction to correct meandering of the belt member, wherein an abutting position of the coupling member with respect to the abutting member when moving the coupling member in the forward direction and an abutting position of the coupling member with respect to the abutting member when moving the coupling member in the reverse direction are variable to support respective movement directions, one end of the coupling member is coupled to a shaft of the first roller member, and other end of the coupling member is formed to sandwich the abutting member in the forward direction and the reverse direction, so that a central section constitutes a center of swinging.

2. An image forming apparatus comprising a belt device that includes a belt member that is supported by a plurality of roller members including a first roller member and moves in a predetermined direction of movement;

a coupling member that is coupled with the first roller member; and an abutting member that makes contact with the coupling member by changing tilting of a rotational axis of the first roller member and moves the coupling member in a forward direction and a reverse direction to correct meandering of the belt member, wherein an abutting position of the coupling member with respect to the abutting member when moving the coupling member in the forward direction and an abutting position of the coupling member with respect to the abutting member when moving the coupling member in the reverse direction are variable to support respective movement directions, one end of the coupling member is coupled to a shaft of the first roller member, and other end of the coupling member is formed to sandwich the abutting member in the forward direction and the reverse direction, so that a central section constitutes a center of swinging.

* * * * *